US007017529B1

(12) United States Patent
Lomax, Jr. et al.

(10) Patent No.: US 7,017,529 B1
(45) Date of Patent: Mar. 28, 2006

(54) BOILER SYSTEM AND METHOD OF CONTROLLING A BOILER SYSTEM

(75) Inventors: Franklin D. Lomax, Jr., Arlington, VA (US); Thomas J. Heffernan, Burke, VA (US); Khalil M. Nasser, Alexandria, VA (US); John S. Lettow, Washington, DC (US)

(73) Assignee: H2GEN Innovations, Inc., Alexandria, VA (US)

( * ) Notice: Subject to any disclaimer, the term of this patent is extended or adjusted under 35 U.S.C. 154(b) by 0 days.

(21) Appl. No.: 11/153,443

(22) Filed: Jun. 16, 2005

(51) Int. Cl.
*F22B 21/02* (2006.01)

(52) U.S. Cl. ..... 122/235.15; 122/235.16; 122/470; 122/7 R

(58) Field of Classification Search ..... 122/33, 122/235.29, 235.11, 235.14, 235.16, 448.1, 122/235.15, 271, 303, 7 R, 240.1, 240.2, 122/469, 470
See application file for complete search history.

(56) References Cited

U.S. PATENT DOCUMENTS 3,574,302 A * 4/1971 Csathy ..... 122/7 R
4,177,765 A * 12/1979 Wehrmeister ..... 122/4 D
4,336,770 A * 6/1982 Kaneko et al. ..... 122/266
4,482,004 A * 11/1984 Grover ..... 165/47

* cited by examiner

*Primary Examiner*—Gregory Wilson
(74) *Attorney, Agent, or Firm*—Oblon, Spivak, McClelland, Maier & Neustadt, P.C.

(57) ABSTRACT

A boiler system including a first manifold, a second manifold provided at an elevation above the first manifold, and a heat exchanger conduit fluidly connecting the first and second manifolds. The conduit is provided within a first fluid flow, and the heat exchanger conduit receives a second fluid. A thermocouple is provided within the second manifold to measure a temperature of the second fluid within the second manifold. A control unit is provided to maintain a level of liquid phase of the second fluid such that liquid phase of the second fluid does not enter the second manifold based on the temperature measured by the thermocouple. The boiler system can be provided with first and second conduits, where the second conduit is provided within the first fluid flow downstream of the first conduit, and where the first and second conduits are inclined with respect to a vertical axis.

35 Claims, 3 Drawing Sheets

BOILER SYSTEM AND METHOD OF CONTROLLING A BOILER SYSTEM

BACKGROUND OF THE INVENTION

1. Field of the Invention

The present invention relates generally to heat exchangers and methods of controlling heat exchangers.

2. Discussion of the Background

Boilers are utilized as heat exchangers in numerous applications. Boilers typically utilize heat transfer liquid within a tube to absorb heat from an outside source, and then transfer a substantially liquid-free vapor fraction of the heated fluid to a desired location for use. The heated fluid within the boiler is typically in both a gaseous phase and a liquid phase. Boilers are particularly advantageous for use in a configuration in which it is desired to prevent the presence of heat transfer fluid in a liquid phase at a location downstream of the boiler.

A related art boiler 430 is depicted in FIGS. 4A and 4B. The boiler 430 is provided along a flue 414. The boiler 430 includes a first manifold 432, a second manifold 442 provided at an elevation directly vertically above the first manifold 432, and heat exchanger tubes 452, 454, 456, and 458 fluidly connecting the first manifold 432 to the second manifold 442. A first fluid contacts an outer surface of the tubes, and a second fluid is provided within an interior of the tubes.

FIG. 4A depicts the boiler 430 in a non-operational state, and FIG. 4B depicts the boiler in an operational state. In the non-operational state depicted in FIG. 4A, the liquid phase level in each of the conduits 452, 454, 456, and 458 are at an identical vertical height and parallel to the horizon due to gravitational forces acting on the second fluid and uniform temperature distribution of the second fluid in the conduits. In the operational state when the first fluid flow C is present as depicted in FIG. 4B, the conduits located upstream in the first fluid flow B will be in contact with the highest temperature first flow. As the conduits absorb heat from the first fluid flow A, then each succeeding downstream conduit will be in contact with first flow at a sequentially lower temperature. This temperature distribution will shift the non-operational state of the liquid phase level (depicted in FIG. 4A) to the liquid phase levels depicted in FIG. 4B.

The inventors have noted that the above shift in liquid phase levels in the conduits tends to create a situation in which the liquid phase level of the downstream conduit 458 wants to rise to a level at which it reaches the second manifold 442. If the liquid phase level reaches the second manifold 442, it may contaminate system components of the second fluid flow located downstream of the boiler 430. Additionally, if the liquid phase level reaches the second manifold 442, the second fluid in the liquid phase may cascade into the other conduits and create a circular flow (counterclockwise in FIG. 4B) of liquid phase fluid within the boiler, which would significantly degrade the efficiency of the boiler. Since the water cascading from the tube 458 is at or below the saturation temperature at the operating temperature, such cascading overflow will cool the tubes 452, 454 and 456, potentially quenching them to a temperature at or below saturation. This quenching causes a temporary interruption of vapor production, which can cause serious damage to downstream systems supplied by the boiler.

Commonly-used boilers ensure a constant flow of substantially dry vapor by separating the vapor in one or more centrifugal, or cyclone, separators, followed by metering through a control valve. This requires maintenance of a predetermined water level, usually at a point in the manifold 442 as well as the operation of one or more high temperature vapor metering valves. The liquid level must also be measured in such a scheme, usually by use of a commonly-used level sensor selected from the family including sight glasses, mechanical floats, ultrasonic, radar and capacitance. Such sensors are usually confronted by one or more problems such as a severe sensitivity to overheating, susceptibility to corrosion and fouling, large size, high cost and complexity, and low resolution. Because many non-contact sensors such as radar also require large minimum distances for sensing, they are poorly suited to operation in small boilers.

Prevention of tube overflow problems using traditional level sensors requires an increase the size of the system and tends to provide a system that is not robust against operational upsets.

It is therefore desirable to provide a boiler system that overcomes the above restrictions.

SUMMARY OF THE INVENTION

The present invention advantageously provides a boiler system including a first manifold, a second manifold provided at an elevation above the first manifold, and a heat exchanger conduit fluidly connecting the first and second manifolds. The conduit is provided within a first fluid flow, and the heat exchanger conduit receives a second fluid. A thermocouple is provided within the second manifold to measure a temperature of the second fluid within the second manifold. A control unit is provided to maintain a level of liquid phase of the second fluid such that liquid phase of the second fluid does not enter the second manifold based on the temperature measured by the thermocouple. This level control can be effected by increasing the sensible heat content of the first fluid, by decreasing the mass flowrate of the second fluid, or by a combination of these actions.

The boiler system preferably includes a first heat exchanger conduit and a second heat exchanger conduit, where the second heat exchanger conduit is configured to be provided within the first fluid flow at a location downstream of the first heat exchanger conduit. The first and second heat exchanger conduits are preferably inclined with respect to a vertical axis. For example, the first and second heat exchanger conduits are inclined with respect to the vertical axis within a range of between about 35 degrees and about 45 degrees. The boiler system preferably includes a second heat exchanger conduit that has a larger heat exchanger surface area than the first heat exchanger conduit. For example, the second heat exchanger conduit preferably has a higher concentration of heat exchanger fins on an exterior surface thereof than the first heat exchanger conduit. The control unit is preferably configured to maintain a minimum distance between an upper level of liquid phase of the second fluid and the second manifold.

The present invention also advantageously provides a boiler system including a first manifold, and a second manifold provided at an elevation above the first manifold. A first heat exchanger conduit fluidly connects the first manifold to the second manifold, and the first heat exchanger conduit is configured to be provided within a first fluid flow. The first heat exchanger conduit is configured to receive a second fluid. A second heat exchanger conduit fluidly connects the first manifold to the second manifold. The second heat exchanger conduit is configured to be provided within the first fluid flow at a location downstream of the first heat exchanger conduit, and the second heat exchanger conduit is configured to receive the second fluid. The first heat exchanger conduit and the second heat exchanger conduit are preferably inclined with respect to a vertical axis.

The present invention further advantageously provides a boiler system including a first manifold, a second manifold provided at an elevation above the first manifold, and at least one heat exchanger conduit fluidly connecting the first manifold to the second manifold. The conduit is configured to be provided within a first fluid flow, and is configured to receive a second fluid. The boiler system further includes means for maintaining a level of liquid phase of the second fluid such that liquid phase of the second fluid does not enter the second manifold based on a temperature of the second fluid within the second manifold.

The present invention additionally advantageously provides a method of controlling a boiler system, where the method includes providing, within a first flow, at least one heat exchanger conduit fluidly connecting a first manifold to a second manifold, and where the second manifold is provided at an elevation above the first manifold. The method also includes providing a second fluid within the at least one heat exchanger conduit, measuring a temperature of the second fluid within the second manifold, and maintaining a level of liquid phase of the second fluid such that liquid phase of the second fluid does not enter the second manifold based on the measured temperature.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which.

DETAILED DESCRIPTION OF THE INVENTION

Figure 1:
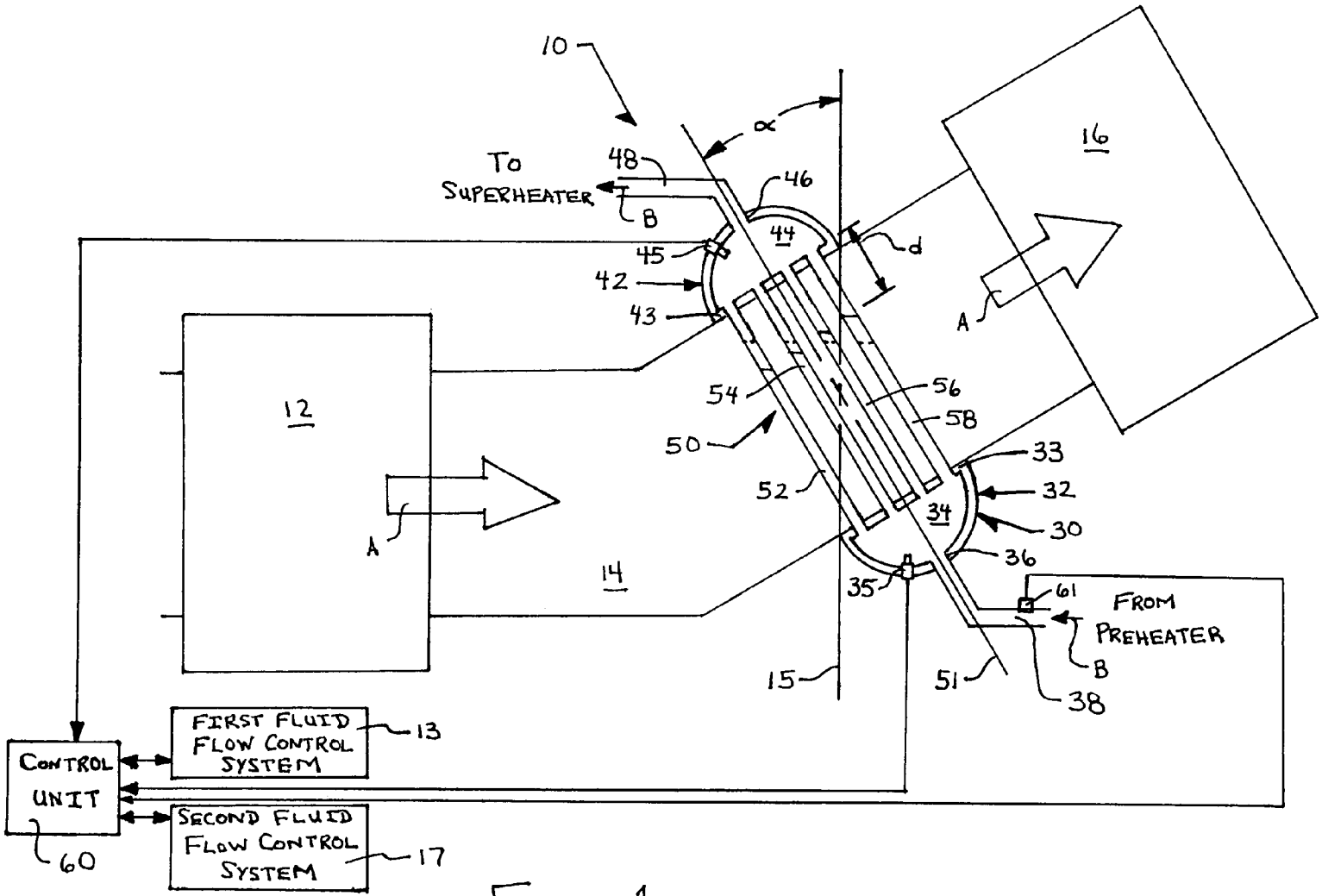
FIG. 1 is a schematic view of an embodiment of a boiler system according to the present invention incorporated in a superheated vapor generation system.

Embodiments of the present invention will be described hereinafter with reference to the accompanying drawings. In the following description, the constituent elements having substantially the same function and arrangement are denoted by the same reference numerals, and repetitive descriptions will be made only when necessary.

FIG. 1 is a schematic view of an embodiment of a boiler system 10 according to the present invention incorporated in a superheated vapor generation system. FIG. 1 generically depicts a superheating heat exchanger or superheater 12 having a flue 14 that carries a heated first fluid flow (represented by arrows A) discharged from the superheater 12. The superheater can be directly-fired or indirectly fired. The flue 14 carries the first fluid flow A through the boiler of the present invention, and then optionally to an additional heat exchanger 16, which can be, for example, a preheater or economizer used to preheat a second fluid flow. Although the arrangement of a superheater 12, a boiler 30 and an economizer 16 is desirable when a superheated vapor of the second fluid is desired, alternative embodiments of the boiler of the present invention may be preferred when only a saturated vapor is required, or when the additional energy recovery from the first fluid A can not be justified on economic grounds, or where heating of some other stream is desired. The arrangement of heat exchangers around the boiler does not limit the application of the boiler of the present invention in any way.

The boiler system 10 includes a boiler 30 provided along the flue 14 between the superheater 12 and the economizer 16. The boiler 30 includes a first manifold 32, a second manifold 42 provided at an elevation above the first manifold 32, and at least one heat exchanger conduit fluidly connecting the first manifold 32 to the second manifold 42. In the embodiment depicted in FIG. 1, a plurality of heat exchanger conduits are provided as a tubular array 50. The boiler 30 is configured to receive and carry a second fluid flow (represented by arrows B), which is typically present in both a gaseous phase and a liquid phase within the boiler 30.

The boiler 30 carries the second fluid flow B within an interior (i.e. tube-side) of the tubular array 50. The boiler 30 allows the first fluid flow to contact an outer surface (i.e. shell-side) of the tubular array 50 and exchange heat between the first fluid flow A and the second fluid flow B. In the embodiment depicted in FIG. 1, the boiler 30 receives in the first manifold 32 the second fluid flow B in a predominantly-liquid phase from an economizer, which can be provided at the additional heat exchanger 16. Alternatively, the second fluid B can be provided without any preheating. In either case, the vapor quality, or mass fraction of vapor in the fluid B at the inlet manifold 32 is less than 0.25. The second fluid flow B is heated by the first fluid flow A as the second fluid flow B travels through the tubular array 50, and the second fluid flow B is heated to a temperature in which the second fluid flow B transitions to a gaseous phase at the second manifold 42. The gaseous phase second fluid flow B then travels from the second manifold 42 to a superheater 12, which can further heat the second fluid flow B using another heat exchanger in an upstream portion of the flue 14, for example. Many technically-important fluids such as water, petroleum fractions, and alcohols contain dissolved impurities which can form solid deposits as the liquid B is evaporated. Droplets or bulk flow of liquid from the discharge manifold 42 conveyed downstream with the vapor phase of fluid B can therefore lead to clogging deposits in downstream equipment, such as the superheater 12. Therefore, it is desired to maintain a substantially liquid-free state in the vapor discharged from the manifold 42.

As mentioned above, the boiler 30 has a first manifold or mud drum 32. The first manifold 32 includes a header plate 33, an internal fluid chamber 34, and an inlet 36. The header plate 33 fluidly connects the internal fluid chamber 34 to the tubular array 50. The inlet 36 fluidly connects the internal fluid chamber 34 to a preheater or other fluid source via a fluid conduit 38. A thermocouple 35 is provided in the first manifold 32 to measure a temperature of the second fluid within the first manifold. The thermocouple 35 is preferably provided directly within the first manifold 32, however alternatively the thermocouple can be provided upstream of the first manifold 32 (e.g., within conduit 38) if necessary.

As mentioned above, the boiler 30 has a second manifold or steam drum 42. The second manifold 42 includes a header plate 43, an internal fluid chamber 44, and an outlet 46. The header plate 43 fluidly connects the internal fluid chamber 44 to the tubular array 50. The outlet 46 fluidly connects the internal fluid chamber 44 to a superheater 12 or other destination via a fluid conduit 48. A temperature sensor 45 is provided in the second manifold 42 to measure a temperature of the second fluid within the second manifold. The temperature sensor 45 is preferably provided directly within the second manifold 42, however alternatively the temperature sensor can be provided downstream of the second manifold 42 (e.g., within conduit 48) if necessary. The temperature sensor can be chosen from temperature sensors such as thermocouples, thermistors, resistance temperature detectors (RTDs), bimetallic thermometers, infrared detectors and the like. The term thermocouple is used here interchangeably with temperature sensor, although the choice of sensor does not limit the present invention.

As mentioned above, the boiler 30 includes at least one heat exchanger conduit fluidly connecting the first manifold 32 to the second manifold 42. The embodiment depicted in FIG. 1 includes a tubular array 50; however, it is possible to have an embodiment with a single heat exchanger conduit fluidly connecting the first manifold 32 to the second manifold 42. The tubular array 50 depicted in FIG. 1 includes a first conduit or row of first conduits 52, a second conduit or row of second conduits 54, a third conduit or row of third conduits 56, and a fourth conduit or row of fourth conduits 58. The tubular array 50 can be provided with any number of conduits and any number of rows of conduits, and the conduits can be provided in any desired positional configuration. In the embodiment of FIG. 1, the first conduits 52 are upstream of the second conduits 54 in the first fluid flow A, the second conduits 54 are upstream of the third conduits 56 in the first fluid flow A, and the third conduits 56 are upstream of the fourth conduits 58 in the first fluid flow A.

The boiler 30 depicted in FIG. 1 is advantageously tilted or inclined at an angle with respect to a vertical axis 15. FIG. 1 depicts an axis 51 that extends along the axis of the boiler 30 and that is parallel to the conduits 52, 54, 56, and 58 in the tubular array 50. The axis 51 is provided at an angle $\alpha$ with respect to the vertical axis 15, along which gravity acts. The conduits 52, 54, 56, and 58 are provided at an angle $\alpha$ that is greater than or equal to zero degrees and less than ninety degrees. The conduits 52, 54, 56, and 58 are preferably provided at an angle $\alpha$ within a range of between about thirty-five degrees and about forty-five degrees.

In the non-operational state, the liquid phase level in each of the conduits 52, 54, 56, and 58 are at an identical vertical height and parallel to the horizon due to gravitational forces acting on the second fluid. In an operational state when the first fluid flow A is present, the conduit or row of conduits located upstream in the first fluid flow A will be in contact with the highest temperature first flow. As the conduits will absorb heat from the first fluid flow A, then each succeeding downstream conduit or row of conduits will be in contact with first flow at a sequentially lower temperature. Thus, in the embodiment depicted in FIG. 1, the conduit or row of conduits 52 will be in contact with a first flow having a highest temperature, the conduit or row of conduits 54 will be in contact with a first flow having a temperature lower than conduits 52, the conduit or row of conduits 56 will be in contact with a first flow having a temperature lower than conduits 54, and the conduit or row of conduits 58 will be in contact with a first flow having a temperature lower than conduits 56. Because of the lower temperature condition of the first fluid A, the logarithmic mean temperature difference (LMTD) for each successive row of conduits is reduced relative to the preceding conduits. The LMTD is related to the maximum quantity of heat that can be transferred in a given conduit by the following relationship:

Q=heat transferred=Conduit area×heat transfer coefficient×LMTD.

The heat transferred, Q, is directly proportional to the mass flowrate of liquid B which can be vaporized completely to a quality of 1.0. Therefore, the first conduits 52 will vaporize more fluid B than the conduits 54, which vaporizes more than 56, which in turn vaporizes more than 58. Irrespective of the number of successive conduits provided, the last conduit will always have the least LMTD. Because gravity acts to maintain the liquid level relatively constant in each conduit relative to axis 15, a greater quantity of fluid B will flow to the conduits having the greater LMTD. Because of the enormous volume expansion experienced during vaporization, the conduits having a greater vapor production rate will also experience a greater viscous drag between the flowing vapor and the conduit, and thus a greater pressure loss or "head." Thus, during the operational state, the fluid levels in the conduits will vary somewhat depending upon their respective position in the duct. The dashed lines show the effect of this variation in friction head in each conduit.

If the overall quantity of heat available for transfer from fluid A is insufficient to vaporize the entire fluid flow B, the liquid level will rise in all of the conduits. Because of its low LMTD, the final conduit 58 will be the first to exceed the critical heat flux where the fluid can not be vaporized completely.

If the liquid level in the final conduit 58 then rises above the header 43, liquid cascades into the other conduits, create a circular flow (counterclockwise in FIG. 1) of liquid phase fluid within the boiler. The circulating cold fluid from conduit 58 causes a rapid cooling of the other conduits, potentially reducing the temperature below the saturation temperature overall, and temporarily stopping vapor production. Even in the absence of complete interruption of vapor flow, the proportion of liquid fluid B in the vapor delivered from the outlet 48 rises, and in the extreme case, substantially pure liquid B can be transmitted through the outlet conduit 48 to downstream equipment.

With that in mind, the inventors note that the boiler provides the most efficient transfer of heat when the conduits in the tubular array 50 are filled with unvaporized liquid to the highest level consistent with the prevention of circulating flow, because of the extremely high ratio between the boiling heat transfer rate achieved when some liquid is present and the purely vapor-phase condition. The present inventor provides a boiler system 10 that prevents or limits liquid phase second fluid from entering the second manifold 42, while providing a high level of liquid phase second fluid in each of the conduits of the tubular array 50, thereby providing an efficient and robust system.

As discussed above, the boiler system 10 of the present invention advantageously provides a boiler 30 that is tilted or inclined at an angle with respect to a vertical axis 15. The conduits 52, 54, 56, and 58 are provided at an angle $\alpha$ that is greater than zero degrees and less than ninety degrees, and preferably within a range of between about thirty-five degrees and about forty-five degrees. This tilt allows the boiler 30 to have an operational state as depicted in FIG. 1 in which the liquid phase levels in each of the conduits or rows of conduits 52, 54, 56, and 58 are located at a distance that is a uniform or a substantially uniform distance d from the header plate 43 of the second manifold 42. Thus, during operation of the boiler 30, the second fluid flow B can be controlled such that the distance d is reduced to a minimum, thereby providing each of the conduits 52, 54, 56, and 58 with the maximum amount of liquid phase second fluid as possible. It is noted that the distance between each individual conduit or row of conduits and the second manifold does not have to be uniform or substantially uniform. In fact, the angle $\alpha$ can be increased until the length d is almost equal to the conduit length in the last downstream conduit 58. Beyond this limit, the conduit 58 is continuously-filled with vapor phase fluid B, causing similar operational problems as in the case where the liquid fluid B circulates.

The boiler system 10 of the present invention includes a control unit 60 that provides an advantageous means for monitoring and controlling the operation of the boiler. The control unit 60 is configured to maintain a level of liquid phase of the second fluid such that the second fluid in the liquid phase does not enter the second manifold 42 based on the temperature measured by the thermocouple 45 provided in the second manifold 42. The control unit 60 is also preferably configured to maintain a predominately liquid phase of the second fluid in the first manifold 32 based on the temperature measured by the thermocouple 35 provided in the first manifold 32. This advantageously prevents the formation of extensive solid deposits in the boiler 30 as well as preventing overheating of the boiler 30. By measuring the temperature characteristics of the boiler 30 using thermocouples 35 and 45, the control unit 60 can calculate the level of liquid phase second fluid in the boiler 30 and adjust the system components accordingly in order to ensure that the liquid phase level does not reach the second manifold. Additionally, the control unit 60 can prevent dryout of the first manifold 32.

The control unit 60 receives signals from the thermocouples 35 and 45 as well as an optional pressure sensor 61, which can be located anywhere in contact with the second fluid where the pressure is substantially equal to the pressure in the boiler 30, for example, in manifolds 32 or 42, or in a location upstream (in the second fluid flow B) of the boiler 30, such as in conduit 38. If the boiler system is operated at a known pressure due to a mechanical control valve, or by merit of being in direct communication with an environment of known pressure (such as the atmosphere or a large vessel), the pressure sensor can be omitted. Once the pressure is known through one of the aforementioned means, the saturation temperature can be estimated reliably based on thermodynamic considerations alone. Therefore, the temperature sensors 35 and 45 can be used to accurately determine whether the second fluid B is in the wholly liquid state or in the wholly gaseous state. It is not possible in a pure fluid to determine the extent of vaporization when quality is between 0 and 1.0, when the temperature remains constant at the saturation temperature. Thus, the temperature sensors 35 and 45 can distinguish between sub-cooled liquid fluid B, saturated liquid B containing an unknown quantity of vapor B, and purely vapor B where the temperature has exceeded the saturation temperature.

The control unit 60 can also exchange information with a first fluid flow control system 13, which controls characteristics such as the amount of first fluid flow A traveling through the flue 14 and the temperature of the first fluid flow A traveling through the flue 14, for example, as these characteristics relate to and are controlled based on various operating conditions of the reactor 12, superheater, etc. The control unit 60 can further exchange information with a second fluid flow control system 17, which controls characteristics such as the amount of second fluid flow B traveling through the boiler 30. The control unit 60 is configured to control the first fluid flow control system 13 and/or the second fluid flow control system 17 in order to maintain a level of liquid phase of the second fluid such that liquid phase of the second fluid does not enter the second manifold 42. Alternatively, the control unit 60 can monitor the thermocouples 35 and 45 and provide a warning system to an operator if the control unit 60 determines that the level of the liquid phase of the second fluid is approaching the second manifold, such that the operator can utilize control systems to avoid such a result.

The present invention can be operated using a single thermocouple 45, without providing thermocouple 35. The thermocouple 45 can be used to monitor the temperature of the atmosphere within the second manifold 42 to ensure that the temperature is above the saturation point of the second fluid. Using the temperature data sensed from thermocouple 45, the control unit 60 can then adjust the system properties in order to control the level of second fluid in the liquid phase to prevent liquid from entering the second manifold 42. For example, the control unit 60 can increase the temperature of the first fluid flow A in order to increase heat transfer to the second fluid flow B, and thereby increase vaporization of the second fluid flow B and reduce the liquid level thereof if needed to prevent liquid phase of the second fluid flow B from entering the second manifold 42. Also, the control unit 60 can reduce the flowrate of the second fluid flow B in order to reduce the liquid phase level of the second fluid if needed to prevent liquid phase of the second fluid flow B from entering the second manifold 42. One disadvantage of such a configuration is that it is difficult or impossible to prevent dryout in the first manifold 32, if a thermocouple is not present in the first manifold 32.

Figure 2:
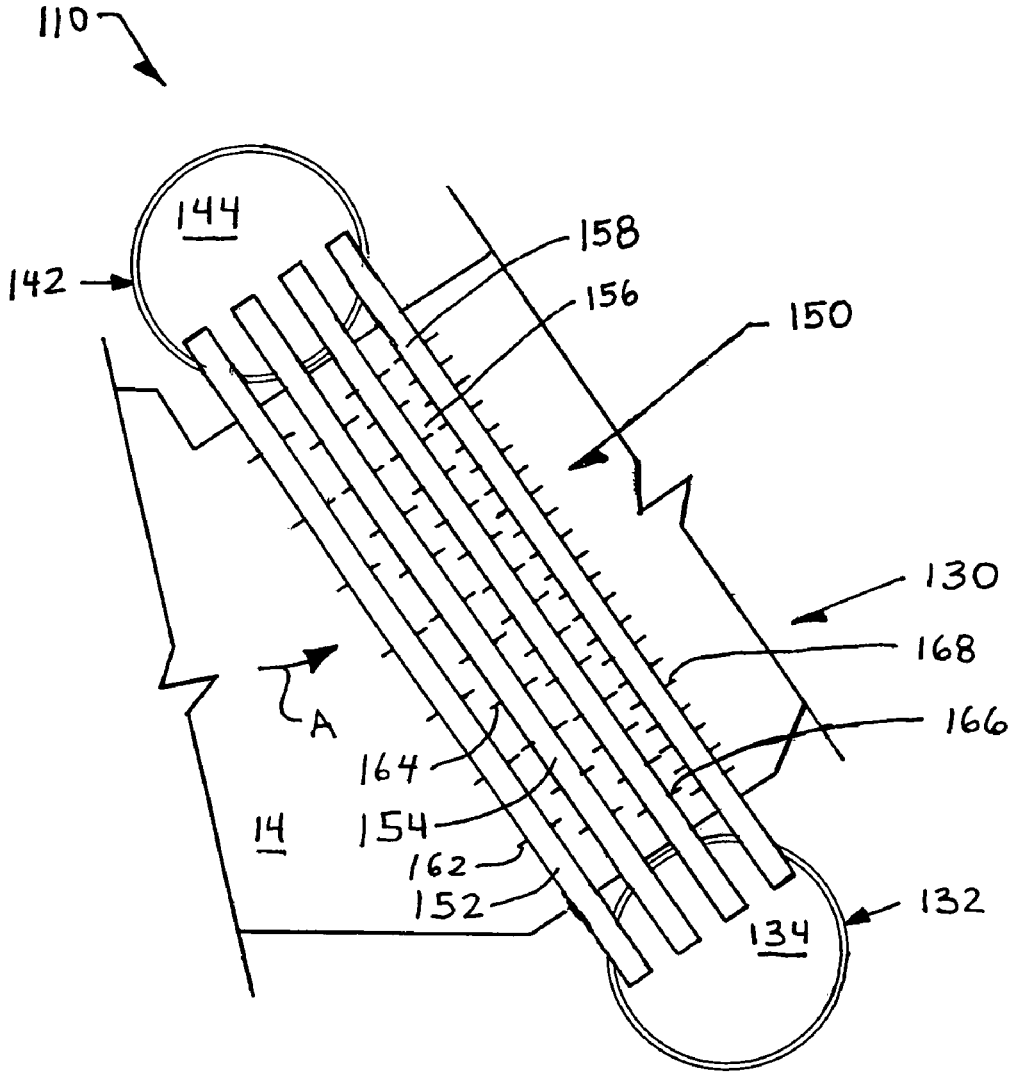
FIG. 2 is an enlarged schematic view of an alternative embodiment of a boiler system according to the present invention.

FIG. 2 is an enlarged schematic view of an alternative embodiment of a boiler system 110 according to the present invention. FIG. 2 depicts a boiler 130 that has an array of fluid conduits 150 that fluidly connects a first manifold 132 to a second manifold 142. The tubular array 150 includes a first conduit or row of first conduits 152, a second conduit or row of second conduits 154, a third conduit or row of third conduits 156, and a fourth conduit or row of fourth conduits 158. Each conduit or row of conduits has a different heat exchange surface area than the other conduits or rows of conduits. Each conduit or row of conduits is preferably provided with a heat exchange surface area that corresponds to that conduit's or that row's location along the stream of the first fluid flow A, which corresponds to the temperature of the first fluid flow at that location along the stream. Thus, the configuration provides a higher heat exchange surface area for conduits provided in a lower temperature first fluid flow, thereby creating a uniform or substantially uniform amount of heat transfer for each of the conduits in the tubular array 150.

FIG. 2 depicts an embodiment in which conduits 152 have heat transfer fins 162 provided on exterior surfaces thereof, second conduits 154 have heat transfer fins 164 provided on exterior surfaces thereof, third conduits 156 have heat transfer fins 166 provided on exterior surfaces thereof, and conduits 158 have heat transfer fins 168 provided on exterior surfaces thereof. The heat transfer fins 162 are provided in a lower concentration than the heat transfer fins 164, the heat transfer fins 164 are provided in a lower concentration than the heat transfer fins 166, and the heat transfer fins 166 are provided in a lower concentration than the heat transfer fins 168. Other configurations of heat transfer fins can be provided, for example, each conduit can be provided with the same number of fins, but the size of the fin can be varied in order to provide a larger heat exchange surface area for downstream conduits as compared to upstream conduits.

Additionally, note that heat transfer fins can be provided that are joined to plural conduits in the same row, and/or plural conduits in multiple rows (e.g., a first fin is attached to conduits 152, 154, 156, and 158, a second fin is attached to conduits 154, 156, and 158, a third fin is attached to conduits 156 and 158, and a fourth conduit is attached to conduit 158). Combining several conduits reduces the total number of fins employed for commonly-used stamped plate fins, thus reducing manufacturing difficulty. Thus, in cases where manufacturing cost is more important than the most optimized performance, the provision of two or more conduits with the same density of heat transfer area may be preferred.

By creating a more uniform amount of heat transfer for each of the conduits in the tubular array 150, the angle $\alpha$ at which the boiler and conduits need to be tilted in order to achieve a uniform or substantially uniform distance d for each of the conduits is reduced.

Figure 3:
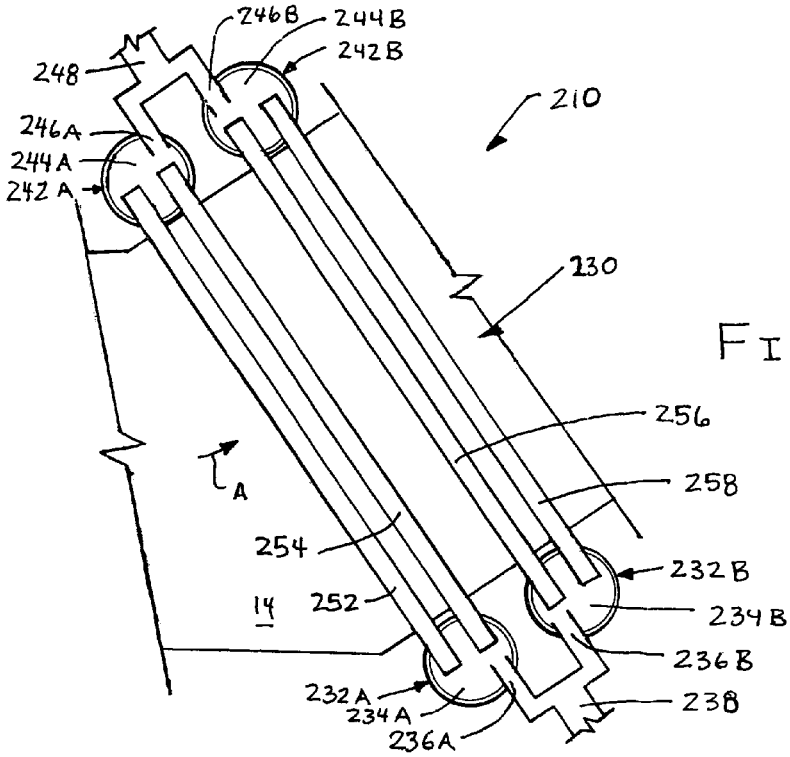
FIG. 3 is an enlarged schematic view of a further alternative embodiment of a boiler system according to the present invention.
Figure 4A:
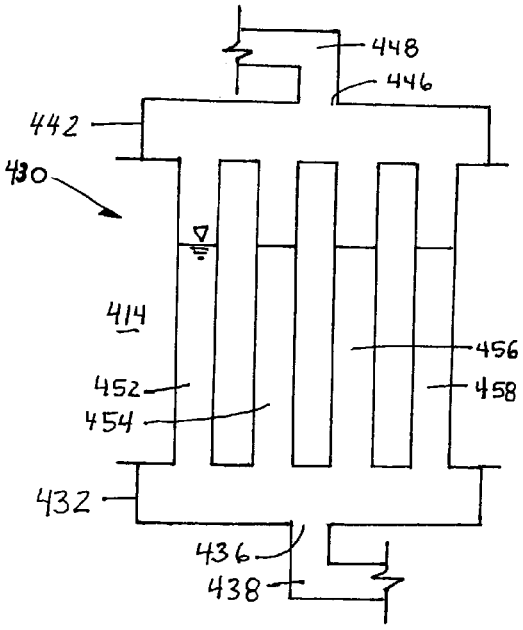
FIG. 4A depicts a schematic view of a related art boiler in a non-operational state.
Figure 4B:
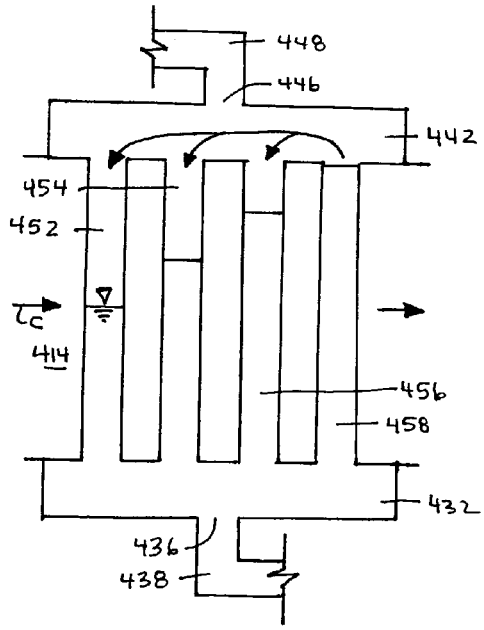
FIG. 4B depicts a schematic view of a related art boiler in an operational state.

FIG. 3 is an enlarged schematic view of a further alternative embodiment of a boiler system 210 according to the present invention. FIG. 3 depicts a boiler 230 that has an array of fluid conduits 250. In this embodiment, the array of conduits 250 includes a first conduit or row of first conduits 252 and a second conduit or row of second conduits 254 that fluidly connect a first manifold portion 232A to a second manifold portion 242A. The array of conduits 250 further includes a third conduit or row of third conduits 256 and a fourth conduit or row of fourth conduits 258 that fluidly connect a first manifold portion 232B to a second manifold portion 242B. The first manifold portion 232A has an inlet 236A, and the first manifold portion 232B has an inlet 236B. The inlet 236A and the inlet 236B are joined to a fluid conduit 238, which fluidly connects the internal fluid chambers 234A and 234B, respectively, to a preheater or other fluid source. The second manifold portion 242A has an outlet 246A, and the second manifold portion 242B has an outlet 246B. The outlet 246A and the outlet 246B are joined to a fluid conduit 248, which fluidly connects the internal fluid chambers 244A and 244B, respectively, to a superheater or other destination.

By providing a first manifold portion 232A fluidly connected to a second manifold portion 242A and a separate first manifold portion 232B fluidly connected to a second manifold portion 242B, this embodiment reduces the chances of a circular flow of liquid phase second fluid developing with in the entire boiler 230. In other words, if the liquid phase level in conduit 258 reaches the second manifold portion 242B, the second fluid in the liquid phase may cascade into conduit 256 thereby creating a circular flow (counterclockwise in FIG. 3) of liquid phase fluid, but will not cascade into conduits 254 and 252. Further, the multiple manifolds of FIG. 3 experience lower mechanical stresses at a given operating pressure than a larger single manifold, and may thus be made advantageously lighter in wall thickness.

The above invention can be utilized in numerous applications. For example, the invention can be advantageously provided in combination with a heat exchange chemical reactor, for example, that produces hydrogen from natural gas, propane, liquefied petroleum gas (LPG), alcohols, naphtha and other hydrocarbon fuels. Such industrial applications can include feedstock for ammonia synthesis and other chemical processes, in the metals processing industry, for semiconductor manufacture and in other industrial applications, petroleum desulfurization, and hydrogen production for the merchant gas market.

It should be noted that the exemplary embodiments depicted and described herein set forth the preferred embodiments of the present invention, and are not meant to limit the scope of the claims hereto in any way.

Numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A boiler system comprising:

a first manifold;

a second manifold provided at an elevation above said first manifold;

at least one heat exchanger conduit fluidly connecting said first manifold to said second manifold, said at least one heat exchanger conduit being configured to be provided within a first fluid flow, said at least one heat exchanger conduit being configured to receive a second fluid;

a thermocouple provided within said second manifold and configured to measure a temperature of the second fluid within said second manifold; and a control unit configured to maintain a level of liquid phase of the second fluid such that liquid phase of the second fluid does not enter said second manifold based on the temperature measured by said thermocouple.

2. The boiler system according to claim 1, wherein said first manifold is configured to be fluidly connected to a preheater.

3. The boiler system according to claim 1, wherein said second manifold is configured to be fluidly connected to a superheater.

4. The boiler system according to claim 1, wherein said control unit is configured to control conditions of the first fluid flow in order to control the temperature of the second fluid within said second manifold.

5. The boiler system according to claim 1, wherein:

said at least one heat exchanger conduit comprises a first heat exchanger conduit and a second heat exchanger conduit, said second heat exchanger conduit being configured to be provided within the first fluid flow at a location downstream of said first heat exchanger conduit, and said first heat exchanger conduit and said second heat exchanger conduit are inclined with respect to a vertical axis.

6. The boiler system according to claim 5, wherein said first heat exchanger conduit and said second heat exchanger conduit are inclined with respect to the vertical axis within a range of between about 35 degrees and about 45 degrees.

7. The boiler system according to claim 5, wherein said second heat exchanger conduit has a larger heat exchanger surface area than said first heat exchanger conduit.

8. The boiler system according to claim 5, wherein said second heat exchanger conduit has a higher concentration of heat exchanger fins on an exterior surface thereof than said first heat exchanger conduit.

9. The boiler system according to claim 1, further comprising an additional thermocouple provided within said first manifold and configured to measure a temperature of the second fluid within said first manifold.

10. The boiler system according to claim 9, wherein said control unit is further configured to maintain the level of liquid phase of the second fluid in said first manifold based on the temperature measured by said additional thermocouple.

11. The boiler system according to claim 1, wherein said control unit is configured to maintain a minimum distance between an upper level of liquid phase of the second fluid and said second manifold.

12. A boiler system comprising:

a first manifold;

a second manifold provided at an elevation above said first manifold;

a first heat exchanger conduit fluidly connecting said first manifold to said second manifold, said first heat exchanger conduit being configured to be provided within a first fluid flow, said first heat exchanger conduit being configured to receive a second fluid; and a second heat exchanger conduit fluidly connecting said first manifold to said second manifold, said second heat exchanger conduit being configured to be provided within the first fluid flow at a location downstream of said first heat exchanger conduit, said second heat exchanger conduit being configured to receive the second fluid, wherein said first heat exchanger conduit and said second heat exchanger conduit are inclined with respect to a vertical axis.

13. The boiler system according to claim 12, wherein said first heat exchanger conduit and said second heat exchanger conduit are inclined with respect to the vertical axis within a range of between about 35 degrees and about 45 degrees.

14. The boiler system according to claim 12, wherein said second heat exchanger conduit has a larger heat exchanger surface area than said first heat exchanger conduit.

15. The boiler system according to claim 12, wherein said second heat exchanger conduit has a higher concentration of heat exchanger fins on an exterior surface thereof than said first heat exchanger conduit.

16. The boiler system according to claim 12, wherein a plurality of first heat exchanger conduits are provided in a row that fluidly connect said first manifold to said second manifold, and wherein a plurality of second heat exchanger conduits are provided that fluidly connect said first manifold to said second manifold.

17. The boiler system according to claim 12, further comprising means for maintaining a level of liquid phase of the second fluid such that liquid phase of the second fluid does not enter said second manifold based on a temperature of the second fluid within said second manifold.

18. The boiler system according to claim 17, wherein said means for maintaining a level of liquid phase of the second fluid such that liquid phase of the second fluid does not enter said second manifold is further configured to maintain the level of liquid phase in said first manifold based on a temperature of the second fluid within said first manifold.

19. The boiler system according to claim 17, wherein said means for maintaining a level of liquid phase of the second fluid such that liquid phase of the second fluid does not enter said second manifold is further configured to maintain a minimum distance between an upper level of liquid phase of the second fluid and said second manifold.

20. The boiler system according to claim 17, wherein said means for maintaining a level of liquid phase of the second fluid such that liquid phase of the second fluid does not enter said second manifold is further configured to control conditions of the first fluid flow in order to control the temperature of the second fluid within said second manifold.

21. A boiler system comprising:

a first manifold;

a second manifold provided at an elevation above said first manifold;

at least one heat exchanger conduit fluidly connecting said first manifold to said second manifold, said at least one heat exchanger conduit being configured to be provided within a first fluid flow, said at least one heat exchanger conduit being configured to receive a second fluid; and means for maintaining a level of liquid phase of the second fluid such that liquid phase of the second fluid does not enter said second manifold based on a temperature of the second fluid within said second manifold.

22. The boiler system according to claim 21, wherein said means for maintaining a level of liquid phase of the second fluid such that liquid phase of the second fluid does not enter said second manifold is further configured to maintain the level of liquid phase in said first manifold based on a temperature of the second fluid within said first manifold.

23. The boiler system according to claim 21, wherein said means for maintaining a level of liquid phase of the second fluid such that liquid phase of the second fluid does not enter said second manifold is further configured to maintain a minimum distance between an upper level of liquid phase of the second fluid and said second manifold.

24. The boiler system according to claim 21, wherein said means for maintaining a level of liquid phase of the second fluid such that liquid phase of the second fluid does not enter said second manifold is further configured to control conditions of the first fluid flow in order to control the temperature of the second fluid within said second manifold.

25. A method of controlling a boiler system, said method comprising:

providing, within a first flow, at least one heat exchanger conduit fluidly connecting a first manifold to a second manifold, the second manifold being provided at an elevation above the first manifold;

providing a second fluid within the at least one heat exchanger conduit;

measuring a temperature of the second fluid within the second manifold; and maintaining a level of liquid phase of the second fluid such that liquid phase of the second fluid does not enter the second manifold based on the measured temperature.

26. The method according to claim 25, wherein maintaining the level of liquid phase of the second fluid such that liquid phase of the second fluid does not enter the second manifold is further performed by maintaining the level of the liquid phase of the second fluid in said first manifold based on a measured temperature of the second fluid within the first manifold.

27. The method according to claim 25, further comprising maintaining a minimum distance between an upper level of liquid phase of the second fluid and the second manifold.

28. The method according to claim 25, wherein maintaining the level of liquid phase of the second fluid such that liquid phase of the second fluid does not enter the second manifold is further performed by controlling conditions of the first fluid flow in order to control the temperature of the second fluid within the second manifold.

29. The method according to claim 25, wherein the first manifold is fluidly connected to a preheater.

30. The method according to claim 25, wherein the second manifold is fluidly connected to a superheater.

31. The method according to claim 25, wherein:

the at least one heat exchanger conduit comprises a first heat exchanger conduit and a second heat exchanger conduit, the second heat exchanger conduit being provided within the first fluid flow at a location downstream of the first heat exchanger conduit, and the first heat exchanger conduit and the second heat exchanger conduit are inclined with respect to a vertical axis.

32. The method according to claim 31, wherein the first heat exchanger conduit and the second heat exchanger conduit are inclined with respect to the vertical axis within a range of between about 35 degrees and about 45 degrees.

33. The method according to claim 31, wherein the second heat exchanger conduit has a larger heat exchanger surface area than the first heat exchanger conduit.

34. The method according to claim 31, wherein the second heat exchanger conduit has a higher concentration of heat exchanger fins on an exterior surface thereof than the first heat exchanger conduit.

35. The method according to claim 31, wherein a plurality of first heat exchanger conduits are provided in a row that fluidly connect the first manifold to the second manifold, and wherein a plurality of second heat exchanger conduits are provided that fluidly connect the first manifold to the second manifold.

* * * * *